US005909886A

United States Patent [19]

Tugutaka et al.

[11] Patent Number: 5,909,886

[45] Date of Patent: Jun. 8, 1999

[54] BINDING FOR SNOWBOARDS

[75] Inventors: Ichikawa Tugutaka, Ota-ku; Umemoto Satoshi, Higashitonami-gun, both of Japan

[73] Assignee: Kabushiki Kaisha Tokyo Ichizuru, Tokyo, Japan

[21] Appl. No.: 08/832,352

[22] Filed: Apr. 2, 1997

[30] Foreign Application Priority Data

Apr. 8, 1996 [JP] Japan ..... 8-110552

[51] Int. Cl.[6] ..... B62B 9/04

[52] U.S. Cl. ..... 280/14.2; 280/620; 280/622

[58] Field of Search ..... 280/14.2, 620, 280/622, 626, 617, 631; 440/70

[56] References Cited

U.S. PATENT DOCUMENTS

| | | | |
|---|---|---|---|
| 5,261,689 | 11/1993 | Carpenter et al. | 280/14.2 |
| 5,503,900 | 4/1996 | Fletcher | 280/14.2 |
| 5,727,797 | 3/1998 | Bowles | 280/14.2 |
| 5,758,895 | 6/1998 | Bumgarner | 280/14.2 |
| 5,769,446 | 6/1998 | Borsoi | 280/14.2 |

*Primary Examiner*—Charles T. Jordan
*Assistant Examiner*—Charles R. Ducker, Jr.
*Attorney, Agent, or Firm*—Armstrong, Westerman, Hattori, McLeland & Naughton

[57] ABSTRACT

A binding for snowboards has a back plate 2 at the rear of a base plate 1, and the back plate 2 is moved back and forth to vertically move side plates 3 which are provided with an ankle strap 32 and a toe strap 33.

5 Claims, 2 Drawing Sheets

BINDING FOR SNOWBOARDS

BACKGROUND OF THE INVENTION

1. Field of the Invention

The present invention relates to a binding to be fixed to a snowboard, and more particularly to a binding (fitting equipment) which can be applied to boots other than dedicated boots and allows to clamp or release a boot with ease.

2. Description of the Related Art

Snowboard boots are roughly classified into two types; one is a hard boot which is similar to ski boots and formed of a reinforced resin or the like, and the other is a soft boot which is made of leather and textile material. The hard boots are mainly used for Alpine skiing at a high speed and provide stable skiing. And, the soft boots are mainly used for free-style skiing to freely ski to jump, spin and the like, allowing skiers to ski quite freely.

Among snowboarders today, most of them enjoys free-style snowboarding, and their equipment often include a free-style board and soft boots.

To clamp a soft boot, a binding designed for the soft boot is generally used. The binding for the soft boot is generally formed of a base plate 1 directly fixed to a snowboard (not shown), a back plate 2 for supporting the rear of the boot, a connector 31 for supporting the back plate 2, an ankle strap 32 for fixing the heel of the boot, and a toe strap 33 for fixing the toe of the boot as shown in FIG. 3. The back plate 2 includes two types, one is high (so-called high back) and the other is low (so-called low back), and the one shown in FIG. 3 is a high back plate. The low back plate is designed mainly for half-pipe to provide freer movement of the ankle at a price for sliding performance. The ankle strap 32 and the toe strap 33 are generally provided with a buckle (a combination of a turn buckle and a ratchet buckle). FIG. 3 shows the binding with two straps fitted, but there is a three-strap type which additionally has a strap for fixing the ankle.

Differing from skiing, you cannot walk flat ground with both feet fixed to the snowboard, and it is necessary to release one or both feet from the board after every sliding. And, since the snowboard can be carried easier than skis, both feet are often released from the board to carry it. Thus, as compared with skis, boots are frequently clamped to and released from the snowboard, so that such operation is desired to be made with ease.

But, the conventional binding for snowboards shown in FIG. 3 requires tightening or releasing of the buckle type straps 32, 33 every time the boot is clamped or released. And, snowboarders have demanded for a binding that the boot can be clamped and released with ease.

SUMMARY OF THE INVENTION

In view of the above circumstances, the present invention aims to provide a binding for snowboards which allows very simple clamping and releasing of a boot.

To accomplish the above object, the present invention relates to a binding for snowboards which has a base plate 1, a back plate 2 positioned at the rear of the base plate 1, and side plates 3 which are positioned on both sides of the base plate I and provided with an ankle strap 32 and a toe strap 33 as shown in, for example, FIG. 1; the side plates 3 are vertically movable by moving the back plate 2 back and forth.

With the binding according to the invention, it is advantageous that the side plates 3 are moved vertically and back and forth as well by moving the back plate 2 back and forth, and it is preferably provided with means for restricting the movement of the back plate.

The binding of the invention is classified into the so-called soft boot binding, and can also be applied to other boots in addition to the soft boots dedicated for snowboarding.

DETAILED DESCRIPTION OF THE PREFERRED EMBODIMENTS

Figure 1A:
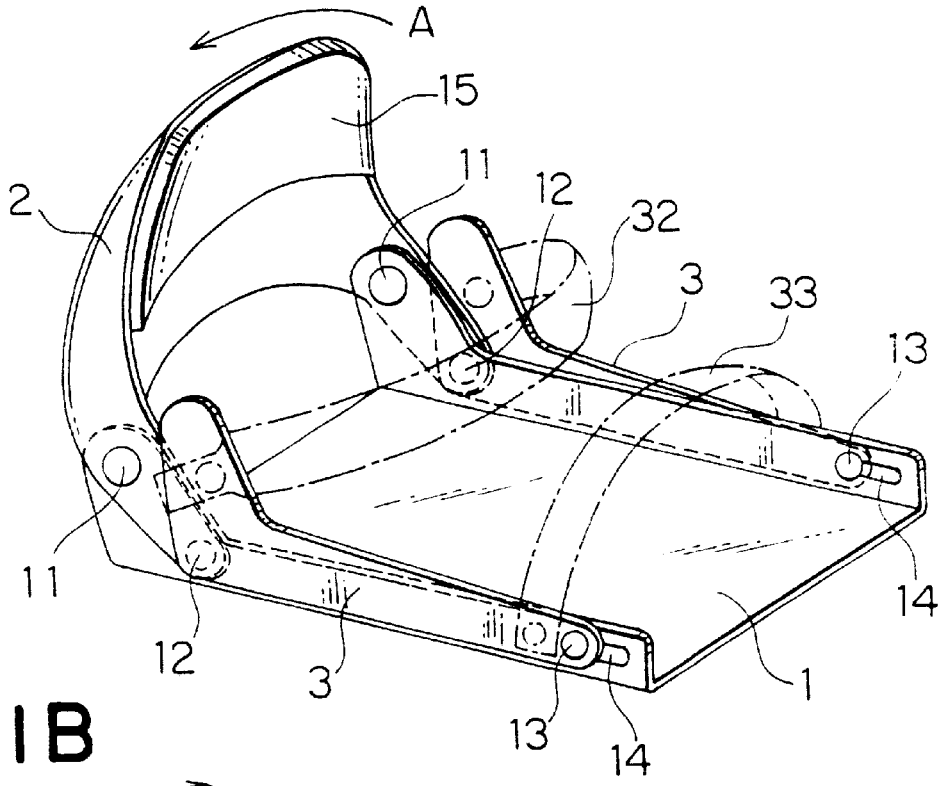
FIG. 1 is a perspective view schematically showing a state of clamping and releasing a boot with the binding in one embodiment of the invention.
Figure 1B:
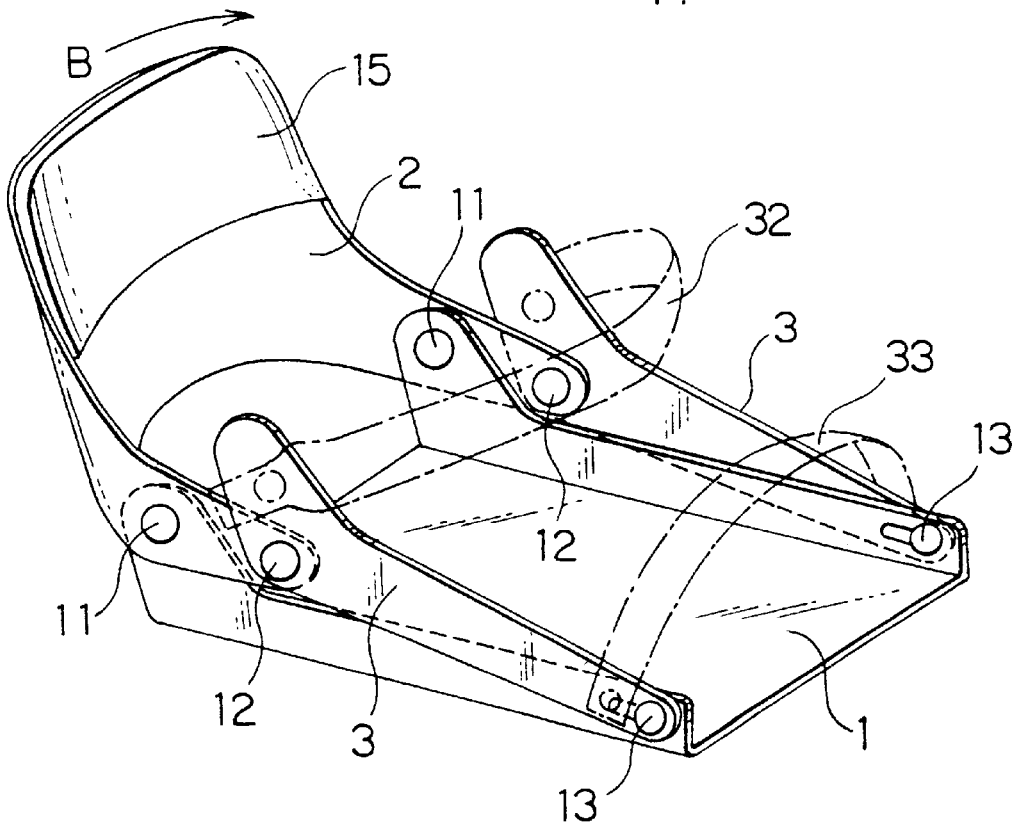

FIG. 1 is a perspective view schematically showing the binding according to one embodiment of the invention. FIG. 1 (*a*) shows a state that a boot is clamped, and FIG. 1 (*b*) shows a state that a boot is released. In the drawing, reference numeral 1 denotes a base plate, 2 a back plate and 3 side plates, they are main components for the binding of the invention.

The base plate 1 has a U-shaped form with both sides bent upward, and its bottom is fixed to a snowboard. The base plate 1 has openings at a plurality of locations in order to mount the back plate 2 and the two side plates 3. To fix the base plate 1 to a snowboard, for example, it can be directly fixed through openings formed in the snowboard to fix a binding. And, when a dedicated part which is called a center disc is used to fix the binding, the bottom of the base plate 1 is modified so as to fit the center disc.

The back plate 2 has a curved face so as to fit the rear face of the boot and it is connected to the rear of the base plate 1 by means of two revolving shafts 11. Therefore, the back plate 2 can be moved back and forth with the revolving shafts 11 as an axis. And, the back plate 2 is provided with a cushion 15 to snugly fit the binding to the boot and to absorb an impact to reduce a load against the ankle.

The two side plates 3 are connected to the back plate 2 by means of first connector shafts 12 different from the revolving shafts 11 and to the front on both sides of the base plate 1 by means of second connector shafts 13.

The first connector shafts 12 are located ahead of the revolving shafts 11, and the second connector shafts 13 are put through a slot hole (oblong hole) 14 which is formed to extend in the direction of the length on either side wall of the base plate 1.

And, an ankle strap 32 is fitted to the rear of the side plates 3, and a toe strap 33 is fitted slightly behind the second connector shafts 13 (to simplify the drawing, these straps are indicated by a dash and dotted line).

To satisfy durability, machinability and lightweight, the base plate 1, the back plate 2 and the side plates 3 are preferably made of a luminum or a reinforced resin. And, the ankle strap 32 and the toe strap 33 can be made in the form of a simple belt, but they are preferably the above-described buckle type such as a turn buckle or a ratchet buckle to provide easy adoptability to various sizes and types of boots and to allow adjustment of tight fitting to some extent at the time of clamping the boot.

With the binding of the invention having the above-described structure, the back plate 2 is turned in the direction indicated by the arrow A in FIG. 1 (*a*) with the revolving shafts 11 as the axis. When the back plate 2 is tilted backward, the first connector shafts 12 located ahead of the revolving shafts 11 move upward, and the rears of the two side plates 3 are largely moved upward (see FIG. 1 (*b*)). In other words, when the boot is clamped (FIG. 1 (*a*)), by tilting the back plate 2 backward, the ankle strap 32 fitted to the rear of the side plates 3 can be largely moved upward, and the toe strap 33 fitted slightly behind the second connector shafts 13 can be slightly moved upward. Therefore, the boot can be released easily.

In the embodiment shown in FIG. 1, the second connector shafts 13 are put through the slot holes 14 which are to extend in the direction of the length on both side walls of the base plate 1, so that when the back plate 2 is tilted backward, the second connector shafts 13 move to reach the front ends of the slot holes 14, and the two side plates 3 move forward in addition to the above-described movement (the large upward movement of the rear parts) (see FIG. 1 (*b*)). In other words, when the boot is clamped (FIG. 1 (*a*)), by tilting the back plate 2 backward, the ankle strap 32 and the toe strap 33 can be moved forward and upward. Accordingly, the boot can be removed quite easily.

On the other hand, to clamp the boot, the above operation is performed in the reverse order. Specifically, after fitting the boot into the binding in the state shown in FIG. 1 (*b*), the back plate 2 is turned in the direction indicated by the arrow B in the drawing, thereby tilting the back plate 2 forward. Thus, the first connector shafts 12 move downward, the second connector shafts 13 move to the back ends of the slot holes 14, and the two side plates 3 move backward and downward. Therefore, the ankle strap 32 and the toe strap 33 move backward and downward to tighten the boot, so that the boot can be clamped quite easily.

The binding of the invention is not limited to the above-described structure, but may have a structure that by the movement of the side plates 3 interlocked with the movable back plate 2, the ankle strap 32 and the toe strap 33 are moved to allow easy clamping and releasing of the boot.

Figure 3:
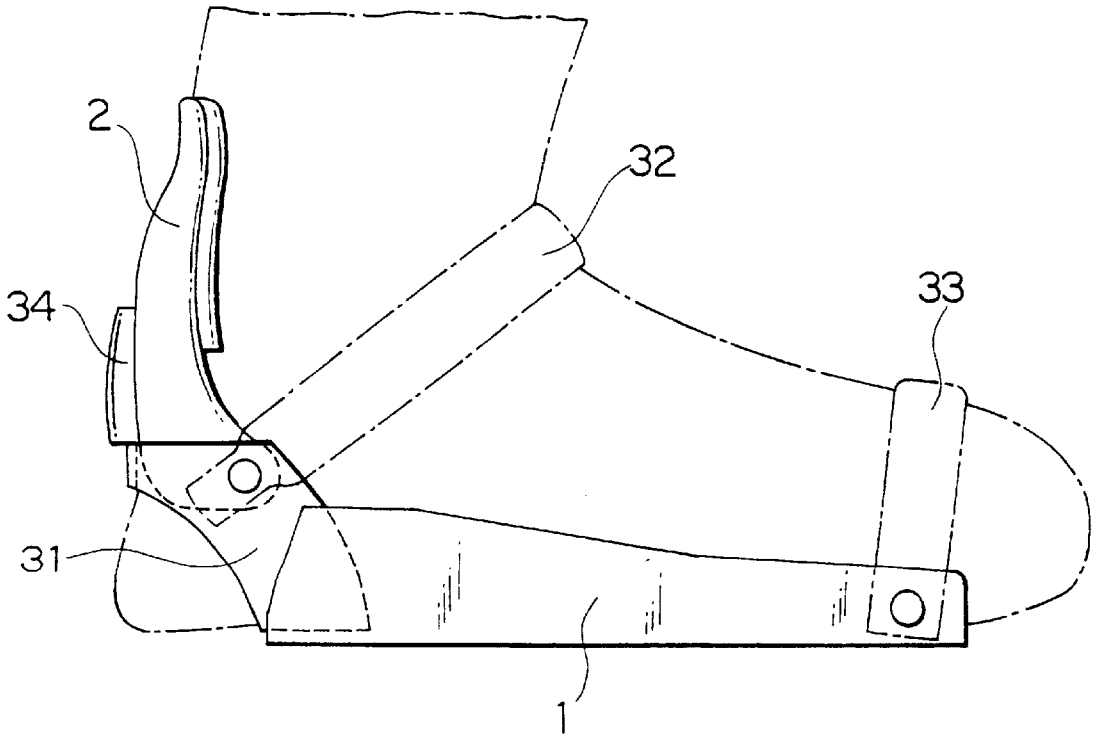
FIG. 3 is a side view showing a conventional binding.

A conventional binding as shown in FIG. 3 may have a movable back plate 2, but it is deigned to merely fold the back plate 2 forward to enable its storage compact. Such a design does not serve for making the clamping and releasing of the boot easy.

When the back plate 2 is designed to be movable, it is necessary to prevent the back plate 2 from becoming unstable when the boot is clamped. With the binding shown in FIG. 3, the boot is fitted with the back plate 2 pushed up and backward, and, therefore, a stopper member 34 is provided on the back face of the back plate 2 to adjust the vertical position of the back plate 2, so that the back plate 2 is prevented from being tilted backward more than necessary and its position is adjusted when the boot is fitted. In other words, when the back plate 2 is pushed up and backward, the position of the back plate 2 is restricted with the bottom end of the stopper member 34 in contact with the top end of the connector member 31.

As to the binding of the invention, it is also necessary to prevent the back plate 2 from becoming unstable when the boot is fitted. Especially, the binding of the invention is designed to tilt the back plate 2 backward to provide easy releasing of the boot, so that it is significant to restrict the movement of the back plate 2 when the boot is clamped.

Figure 2:
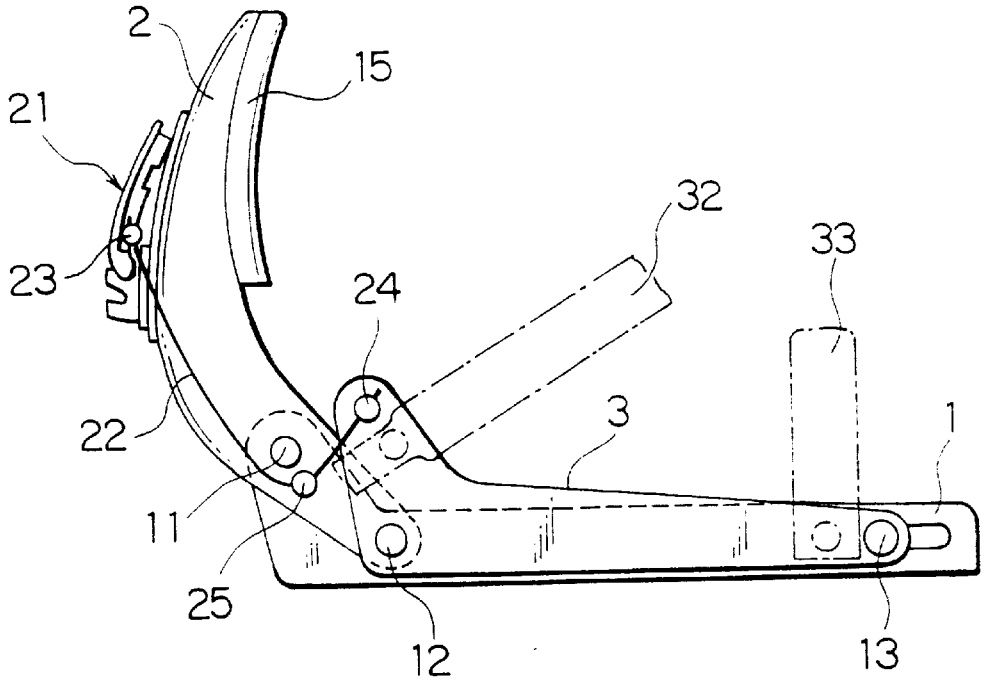
FIG. 2 is a side view schematically showing the binding according to one embodiment of the invention provided with means for restricting the movement of a back plate.

Various means are provided to restrict the movement of the back plate 2 when the boot is clamped. And, for example, a combination of an ordinary turn buckle 21 and a wire 22 as shown in FIG. 2 is simple and reliable. The buckle 21 is fitted to the rear face of the back plate 2. The wire 22 is supported by a fulcrum 23 fixed to the buckle 21 and fulcrums 24 fixed to the side plates 3, and freely movable at relay points 25. When the boot is fitted, the buckle 21 is clamped as shown in FIG. 2, and the wire 22 is tensioned. To release the boot, the buckle 21 is unbuckled to release the tension, and the back plate 2 can be tilted backward. In other words, with the binding structured as shown in FIG. 2, by tightening or releasing the buckle 21, the boot can be fitted or released with ease and also clamped stably and tightly, so that safety while sliding can be secured.

As described above, the binding of the present invention has the following effects.

(1) By moving the back plate back and forth, the ankle strap and the toe strap can be moved vertically, so that the boot can be fitted and released easily.

(2) With the binding that the side plates can also be moved back and forth by moving the back plate back and forth, the ankle strap and the toe strap can be moved up and forward and also down and backward, so that the boot can be fitted and released more easily.

(3) The boot can be clamped stably and tightly by providing means for restricting the movement of the back plate when the boot is fitted, and safety while sliding can be secured.

What is claimed is:

1. A binding for snowboards comprising a base plate, a back plate positioned at the rear of the base plate, and side plates which are positioned on both sides of the base plate and provided with an ankle strap and a toe strap; said side plates being movable vertically by moving the back plate back and forth.

2. The binding for snowboards according to claim 1, wherein said side plates are moved back and forth by moving the back plate back and forth.

3. A binding for snowboards, comprising: a base plate for receiving a boot and has a U-shaped form with both sides bent upward;

a back plate which fits a rear face of the boot and is connected to the base plate by two revolving shafts which are positioned at a rear portion of both sides of the base plate;

two side plates which are positioned on both sides of the base plate and connected to the back plate with first connector shafts which are positioned in front of the revolving shafts and to a front portion on both sides of the base plate with second connector shafts;

an ankle strap which fits an ankle and is connected to a rear portion of the side plates; and a toe strap which fits a toe and is connected to a front portion of the side plates, said side plates being movable vertically by revolving the back plate with the revolving shafts at an axis.

4. The binding for snowboards according to claim 3, wherein said second connector shafts are put through a slot hole which is formed to extend in the direction of the length on either side wall of the base plate, and the side plates being movable backward and forward by revolving the back plate with the revolving shafts as an axis.

5. The binding for snowboards according to any one of claim 1 to 4, further comprising means for restricting the movement of the back plate.

* * * * *